United States Patent [19]

Eysink

[11] Patent Number: 4,898,335

[45] Date of Patent: Feb. 6, 1990

[54] ROLL SUPPORT STAND

[76] Inventor: Ute Eysink, 2624 Rittiner Dr., Baton Rouge, La. 70806

[21] Appl. No.: 310,890

[22] Filed: Feb. 16, 1989

[51] Int. Cl.[4] ..... B65H 19/00

[52] U.S. Cl. ..... 242/55.42; 242/55.54

[58] Field of Search ..... 242/55.2, 55.42, 55.54, 242/68.5, 72.1

[56] References Cited

U.S. PATENT DOCUMENTS

| | | | |
|---|---|---|---|
| 2,889,121 | 6/1959 | Heinle | 242/55.2 |
| 4,030,676 | 6/1977 | Bardsley | 242/55.54 |
| 4,487,376 | 12/1984 | Compton | 242/55.54 |

*Primary Examiner*—David Werner

*Attorney, Agent, or Firm*—Leon Gilden

[57] ABSTRACT

A roll support stand is set forth provided with a vertical post secured to a horizontally oriented circular base wherein a recess aligns the post to the base with a threaded securement member securing the post to the base. An abutment member threadedly securable to an upper end of the base maintains a plurality of aligned tissue rolls onto the base for storage and support thereof. A modified aspect of the invention includes a plurality of pivoted abutments mounted within windows of a hollow veritcal post wherein rotation of the support post containing the rotatable post pivotally wedges plural pairs of the wedge members into securement to rigidly maintain the tissue rolls in alignment with the support post.

4 Claims, 1 Drawing Sheet

ROLL SUPPORT STAND

BACKGROUND OF THE INVENTION

1. Field of the Invention

The field of invention relates to support apparatus, and more particularly pertains to a new and improved roll support stand wherein the same provides for storage and securement of multiple rolls of tissue thereon.

2. Description of the Prior Art

The use of various roll support apparatus is well known in the prior art. Heretofore the prior art has failed to provide means for fixedly and securedly storing multiple rolls of tissue. The prior art has heretofore addressed the need for securement and storage of multiple rolls of tissue typically upon a need to dispense the same. For example, U.S. Pat. No. 3,370,805 to Barbee sets forth a horizontal post having rigidly mounted thereto a vertical removable post for storage of a single or a plurality of rolls of tissue with securement of the apparatus to a vertical support, such as a wall or the like. The instant invention is distant from the Barbee patent in setting forth the teaching of providing a mobile support member provided with a rounded support base to minimize abrasive contact with surrounding items and may further utilize clamping members to clamp the rolls to maintain the rolls onto the vertical support member of the instant invention.

U.S. Design Pat. No. 237,232 to Garrett; U.S. Design Pat. No. 201,099 to Barillante; U.S. Design Pat. No. 286,962 to Ruzi; and U.S. Design Pat. No. 277,622 to Servadio illustrate various configurational supports for multiple rolls of tissue but have heretofore failed to provide the unique securement and support structure of the instant invention.

As such, it may be appreciated that there is a continuing need for a new and improved roll support stand which addresses both the problems of securement of the rolls supported thereon and additionally provide for ease of use, and in this respect, the present invention substantially fulfills this need.

SUMMARY OF THE INVENTION

In view of the foregoing disadvantages inherent in the known types of roll support stands now present in the prior art, the present invention provides a roll support stand wherein the same may compactly and readily secure a plurality of rolls of tissue thereon simultaneously minimizing abrasive contact with surrounding articles. As such, the general purpose of the present invention, which will be described subsequently in greater detail, is to provide a new and improved roll support stand which has all the advantages of the prior art roll support stands and none of the disadvantages.

To attain this, the present invention comprises a vertically oriented support post with an abutment ball thereon at an upper end thereof of a diameter greater than the core diameters of the rolls supported by the post. The post may optionally include a plurality of pairs of pivoted securement members operative through diametrically aligned windows within the post to grasp individually the rolls supported on a column about the post.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved roll support stand which has all the advantages of the prior art roll support stands and none of the disadvantages.

It is another object of the present invention to provide a new and improved roll support stand which may be easily and efficiently manufactured and marketed.

It is a further object of the present invention to provide a new and improved roll support stand which is of a durable and reliable construction.

An even further object of the present invention is to provide a new and improved roll support stand which is susceptible of a low cost of manufacture with regard to both materials and labor, and which accordingly is then susceptible of low prices of sale to the consuming public, thereby making such roll support stand economically available to the buying public.

Still yet another object of the present invention is to provide a new and improved roll support stand which provides in the apparatuses and methods of the prior art some of the advantages thereof, while simultaneously overcoming some of the disadvantages normally associated therewith.

Still another object of the present invention is to provide a new and improved roll support stand wherein the same may be readily and effectively manipulated to secure a column of rolls of tissue paper thereon.

Another object of the present invention is to provide a new and improved roll stand wherein the same way utilize plural pairs of grasping members to secure individually the column of rolls secured thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
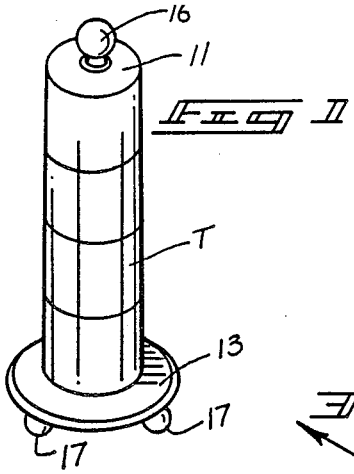
FIG. 1 is an isometric illustration of the instant invention securing a column of rolls thereon.
Figure 2:
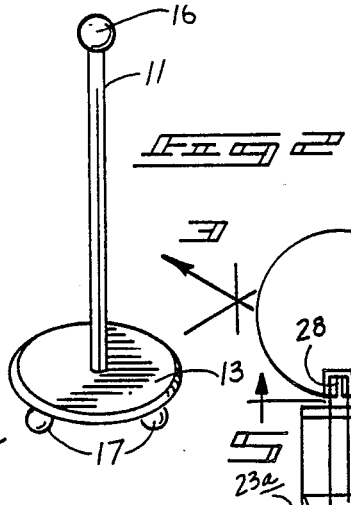
FIG. 2 is an isometric illustration of the instant invention.
Figure 3:
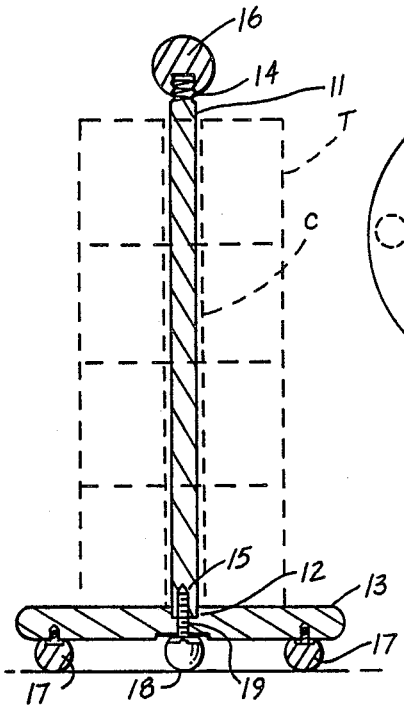
FIG. 3 is an orthographic view taken along the lines 3—3 of FIG. 2 in the direction indicated by the arrows.
Figure 7:
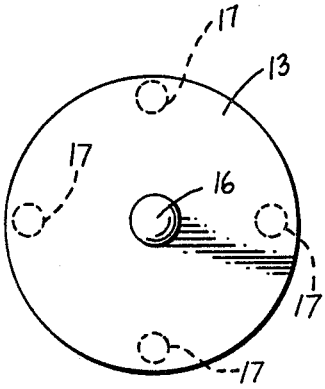
FIG. 7 is a top orthographic view of the instant invention.
Figure 5:
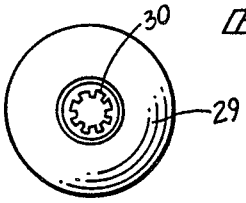
FIG. 5 is an orthographic view taken along the lines 5—5 of FIG. 4 in the direction indicated by the arrows.
Figure 6:
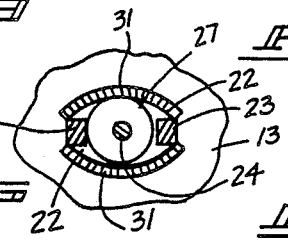
FIG. 6 is an orthographic view taken along the lines 6—6 of FIG. 4 in the direction indicated by the arrows.

With reference now to the drawings, and in particular to FIGS. 1 to 6 thereof, a new and improved roll support stand embodying the principles and concepts of the present invention and generally designated by the reference numeral 10 will be described.

More specifically, it will be noted that the roll support stand apparatus 10 essentially comprises a vertical post 11 secured within a counter-sunk bore 12 of a horizontally oriented circular base 13. The base is circular to minimize impact with surrounding articles in a storage environment. The vertical post 11 is formed with an upper threaded boss 14 and a lower threaded blind bore 15. The upper threaded boss 14 has secured mounted thereto an abutment sphere 16 formed with a threaded internal blind bore therewithin wherein the abutment sphere 16 is of a diameter greater than the diameter cores "C" of the rolls of tissue "T" to prevent undesirable removal or loss of the rolls from the apparatus.

Secured to a lowermost side of the base 13 are a trio of circular support pods 17 to present guide members that minimize friction over a support surface to enable positioning of the apparatus as desired. A securement pot 18 has formed thereto a threaded shank 19 extending upwardly through a bore in the base 13 to be received within the blind bore 15 of the post 11 to secure the post 11 to the base.

In use, a plurality of rolls of tissue "T" may be positioned onto the post 11 upon removal of the abutment sphere 16 whereupon removal of the abutment sphere provides storage of the rolls of tissue "T" until they are removed for use.

Figure 4:
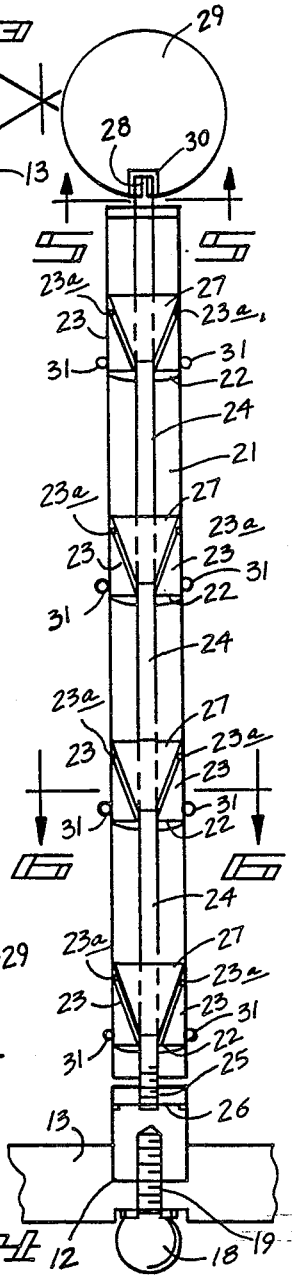
FIG. 4 is an orthographic cross-sectional view of a modified roll support stand of the instant invention.

FIG. 4 illustrates a modified roll support stand 20 formed with a hollow post 21 provided with diametrically aligned paired window openings 22. A pair of window openings 22 are provided for each roll "T" of tissue secured onto the hollow post 21. Pivoted wedge locking members 23 are pivoted at their uppermost ends 23*a* to pivot the paired locking members 23 outwardly of the paired window openings 22. This is effected as the adjustment rod 24 is driven downwardly by clockwise rotation of the adjustment rod to drive the lower threaded end 25 within the threaded plate 26 to receive the lower threaded end 25. Rotation of the adjustment rod 24 is provided by the adjustment sphere 29 provided with a splined cavity 30 overlying a splined upper end 28 of the adjustment rod 24. The adjustment rod 24 is provided with a series of adjusting cones 27 positioned adjacent the pivoted wedge locking members 23 medially and diametrically thereof wherein the adjusting cones 27, when driven between the wedge locking members 23 drive, the locking members 23 outwardly as the individual wedge shape locking members 23 are normally formed with the wedge directed interiorly of the hollow post 21. If desired, an encircling spring 31 may be positioned circumferentially about the hollow post and about the pivot wedge locking members 23 to normally bias the locking members 23 inwardly.

The manner of usage and operation of the instant invention therefore should be understood from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roll support stand for storage of an aligned column of individual rolls of webbing formed with a hollow core of a predetermined diameter, said stand comprising, a horizontal base including a continuous arcuate perimeter, and a counter-sunk blind bore formed medially of an upper surface of said base and extending downwardly from a top surface of said base, and a vertical support post secured to said base orthogonally thereto and extending into said blind bore at a lowermost end of said support post, and a securement member including a threaded shank extending through a bore directed into said blind bore wherein said threaded shank is received within a threaded bore formed in said lower end of said securement post, and an abutment member selectively securable to an upper end of said support post of a further diameter greater than said predetermined diameter, and wherein said support post is hollow and contains plural pairs of aligned windows diametrically opposed along said support post, and wherein said support post further includes an adjustment rod extending medially of said support post wherein said adjustment rod is formed with a threaded lowermost end receivable within a plate, said plate extending orthogonally relative to said threaded lower end and formed with a threaded aperture threadedly receiving said threaded lower end to enable vertical repositioning of said adjustment rod relative to said hollow post.

2. A roll support stand as set forth in claim 1 wherein each pair of windows includes a pivoted wedge-shaped locking member mounted for movement within said window.

3. A roll support stand as set forth in claim 2 wherein said adjustment rod includes an adjusting cone positioned proximate each pair of wedge locking members and positionable from a first position extending above said wedge locking members to a second position aligned with said locking members to extend said wedge locking members outwardly and into contact with each hollow core of each roll.

4. A roll support stand as set forth in claim 3 wherein an uppermost end of said adjustment rod is splined and is receivable within a splined bore formed in said abutment member to enable relative rotation of said adjustment rod by said abutment member.

* * * * *